United States Patent [19]

Garland

[11] Patent Number: 4,799,203

[45] Date of Patent: Jan. 17, 1989

[54] INTERNATIONAL WORLD CLOCK

[76] Inventor: Clifford Garland, 149 Van Brunt St., Brooklyn, N.Y. 11231

[21] Appl. No.: 58,505

[22] Filed: Jun. 1, 1987

[51] Int. Cl.[4] ..... G04B 19/22

[52] U.S. Cl. ..... 368/27

[58] Field of Search ..... 368/21, 27, 22, 23

[56] References Cited

U.S. PATENT DOCUMENTS

| | | | |
|---|---|---|---|
| 1,168,797 | 1/1916 | Giusto | 368/27 |
| 1,926,243 | 9/1933 | Russo | 368/27 |
| 1,935,842 | 11/1933 | Freel | 368/27 |
| 3,002,337 | 10/1961 | Smith | 368/21 |
| 3,358,437 | 12/1967 | Burg | 368/27 |
| 3,486,322 | 12/1969 | Abend et al. | 368/27 |

FOREIGN PATENT DOCUMENTS

| | | | |
|---|---|---|---|
| 563608 | 6/1975 | Switzerland | 368/27 |

*Primary Examiner*—Bernard Roskoski

*Attorney, Agent, or Firm*—Richard L. Miller

[57] ABSTRACT

This international world clock is design to readout a display of time in major cities of the world. Primarily, it consists of a world map panel secured to a pane mounted in an opening of a housing, and a motor is provided in the housing and is provided with an attached disk that is coupled to a time disk rotated by the motor.

2 Claims, 1 Drawing Sheet

INTERNATIONAL WORLD CLOCK

BACKGROUND OF THE INVENTION

The instant invention relates generally to time clocks, and more particularly, to an international world clock.

Numerous clocks have been provided in the prior art that are adapted to indicate time change. For example, U.S. Pat. Nos. of Gardner 1,999,126, De Angelis 2,056,038, Lewis 2,417,695, Smith 3,002,337, Smith 3,232,038, Zoli et al 3,702,056, Wakabayashi 3,918,251 and Lin 4,307,458 all are illustrative of such prior art. While these units may be suitable for the particular purpose to which they address, the would not be as suitable for the purpose of the present invention as hereafter described.

SUMMARY OF THE INVENTION

A primary object of the present invention is to provide an international world clock that will overcome the shortcomings of the prior art devices.

Another object is to provide an international world clock, which will be of such design, as to provide a world map in a housing that will show the time simultaneously in all parts of the world.

An additional object is to provide an international world clock, which will include a calibrated time disk for frontal readout of time in major parts of the world.

A further object is to provide an international world clock that is simple and easy to use.

A still further object is to provide an international world clock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
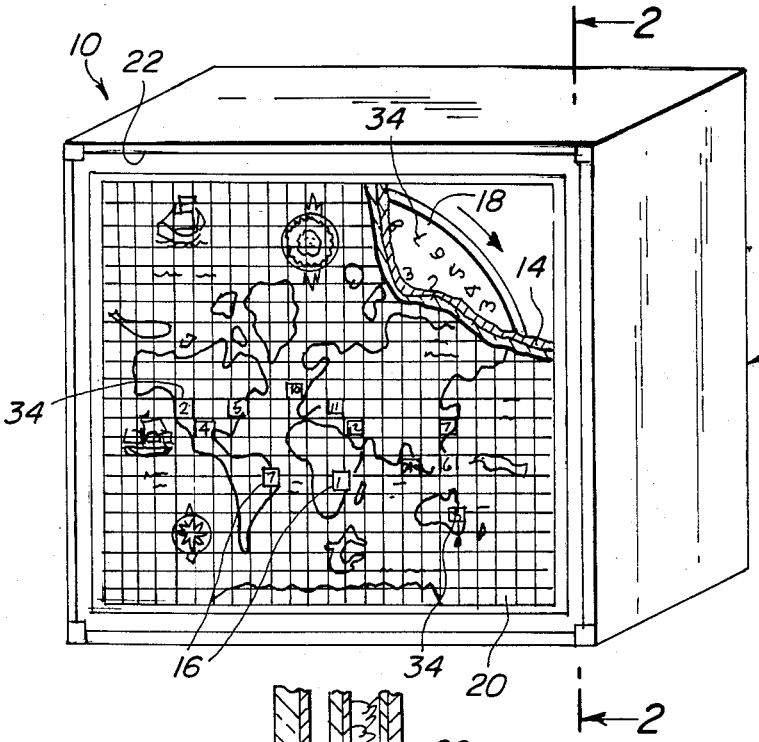
FIG. 1 is a perspective view of the invention with parts broken away illustrating the internal cooperation between parts.
Figure 3:
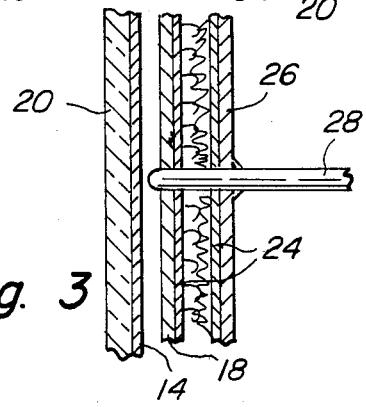
FIG. 3 is an enlarged cross sectional view of another embodiment of the area show in the doted circle of FIG. 2.
Figure 2:
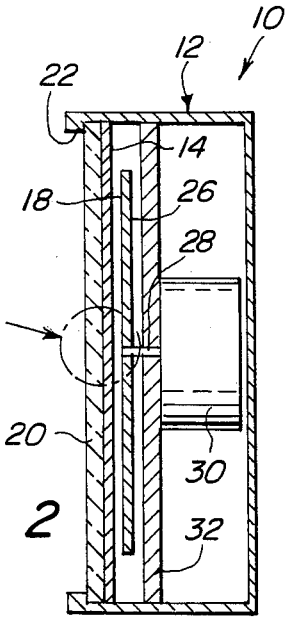
FIG. 2 is across sectional view taken on line 2—2 in FIG. 1 showing the internal mechanism therein.
Figure 4:
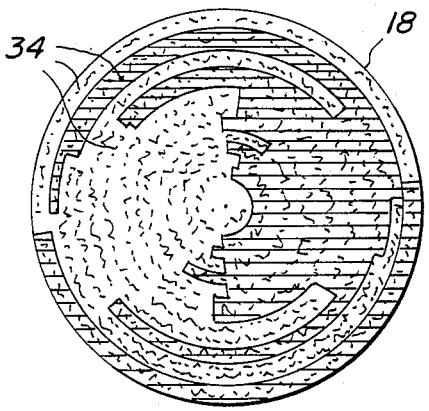
FIG. 4 is a diagrammatic plan view of a typical time disk.
Figure 5:
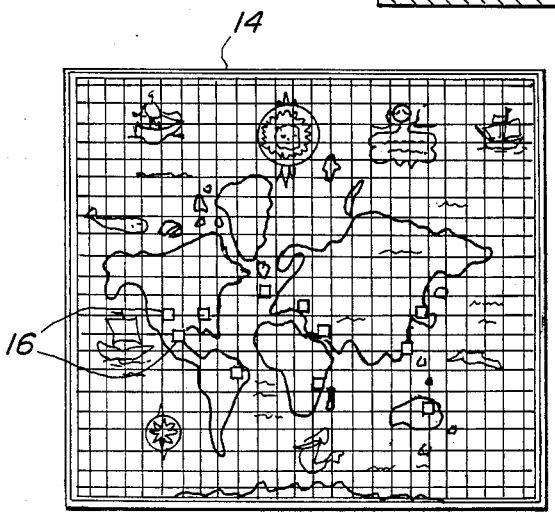
FIG. 5 is a plan view of a typical map which cooperates with the time disk of FIG. 4.

Turning now descriptively to the drawings, in which like reference characters denote like elements throughout the views, FIG. 1 illustrates a clock 10 having a rectangular housing 12 with a front map panel 14 with all of the world continents imprinted thereon, including the meridian lines. Windows 16 are provided in alignment with imprinted numerical characters indicating time on a time disk 18 on the interior of housing 12, and map panel 14 is adhered to a rear face of a transparent pane 20, which is suitably secured in the front opening 22 of housing 12. A pair of mating hook and loop pile fasteners material 24 are adhered to time disk 18 and a second disk 26, for changing disk 18. Disk 26 is fixedly secured to a shaft 28 of an electric motor 30 that is secured to the rear of an intermediate panel 32, and the side edges of panel 32 are suitably secured to the inside surfaces of the walls of housing 12.

In operation, the motor 30 rotates the time disk 18 through the employment of the engaged fasteners 24, and digital time data 34 readout is visible from the disk 18 through the windows 16 for time comparison in cities throughout the world.

In an alternate embodiment other more permanent securement methods, such as adhesives may be used to secure the map and time disk in their respective locations within the instant invention.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An international world clock comprising a housing, a rectangular map panel secured in said housing, for indicating the major cities of the world, a rotatable removable circular time disk received in said housing, and a coupling means for said time disk secured to said time disk and a second disk, for driving said time disk behind said map panel and wherein said map panel is secured to a transparent pane secured in an opening in said housing, and a plurality of windows representing locations are provided through said top panel that align with time calibration imprinted on a face of said time disc, to provide the identical time comparison at all locations, and further comprising a pair of mating hook and loop pile fasteners, one of which is fixedly secured to a rear face of said time disk and another is similarly secured to a face of said second disk.

2. An international world clock as set forth in claim 1, wherein said second disk is fixedly secured to a shaft of a motor mounted to an intermediate wall secured to side walls of said housing and said motor rotates said time disk through said coupling means and visual readout of time from said time disk is effected through the windows through said map panel.

* * * * *